US005578238A

United States Patent [19]

Weiss et al.

[11] Patent Number: 5,578,238

[45] Date of Patent: Nov. 26, 1996

[54] MAGNETORHEOLOGICAL MATERIALS UTILIZING SURFACE-MODIFIED PARTICLES

[75] Inventors: Keith D. Weiss, Eden Prairie, Minn.; J. David Carlson, Cary; Donald A. Nixon, Wilson, both of N.C.

[73] Assignee: Lord Corporation, Cary, N.C.

[21] Appl. No.: 227,297

[22] Filed: Apr. 13, 1994

Related U.S. Application Data

[63] Continuation-in-part of Ser. No. 969,687, Oct. 30, 1992, abandoned.

[51] Int. Cl.[6] ..... H01F 1/44

[52] U.S. Cl. ..... 252/62.52; 252/62.54; 252/62.55; 252/62.56; 252/62.51 R; 252/62.59; 252/62.6; 252/62.63

[58] Field of Search ..... 252/62.52, 62.54, 252/62.55, 62.56, 62.51, 62.59, 62.6, 62.3; 51/317, 318, 313, 281 R, 289 R, 289 S; 427/127, 212, 213, 213.3, 213.34, 216, 217, 221; 428/900, 402, 403, 402.24

[56] References Cited

U.S. PATENT DOCUMENTS

| | | | |
|---|---|---|---|
| Re. 32,573 | 1/1988 | Furumura et al. | 252/62.52 |
| 2,575,360 | 11/1951 | Rabinow . | |
| 2,661,596 | 12/1953 | Winslow | 60/326 |
| 2,661,825 | 12/1953 | Winslow . | |
| 2,663,809 | 12/1953 | Winslow . | |
| 2,667,237 | 1/1954 | Rabinow . | |
| 2,670,749 | 3/1954 | Germer . | |
| 2,733,792 | 2/1956 | Saxl . | |
| 2,886,151 | 5/1959 | Winslow . | |
| 3,010,471 | 11/1961 | Gross . | |
| 3,612,630 | 10/1971 | Rosenweig | 310/90.5 |
| 3,764,540 | 10/1973 | Khalafalla et al. | 252/62.52 |
| 3,843,540 | 10/1974 | Reimers et al. | 252/62.52 |
| 3,917,538 | 11/1975 | Rosensweig | 252/62.52 |
| 4,356,098 | 10/1982 | Chagnor | 252/62.52 |
| 4,992,190 | 2/1991 | Shtarkman | 256/26.52 |
| 5,069,216 | 12/1991 | Groman et al. | 600/9 |
| 5,382,373 | 1/1995 | Carlson et al. | 252/62.55 |
| 5,505,880 | 4/1996 | Kormann et al. | 252/62.54 |
| 5,534,488 | 10/1994 | Shtarkman et al. | 252/62.56 |

FOREIGN PATENT DOCUMENTS

| | | |
|---|---|---|
| 162371 | 10/1952 | Australia . |
| 406692 | 1/1991 | European Pat. Off. . |

OTHER PUBLICATIONS

Journal of the Electrochemical Society, vol. 124, No. 11, Nov. 1977 Manchester GB, pp. 1813–1816, S. Yamaguchi.

Patent Abstracts of Japan, vol. 015, NO. 502 (E–1147), 18 Dec. 1991 & JP–A–03 219602,(Toyota Motor Corp) 27 Sep. 1991.

J. Rabinow, "Technical News Bulletin," vol. 32, No. 5, pp. 54–60, issued by U.S. Dept. of Commerce, May, 1948 describing a magnetic fluid clutch.

The Oxford English Dictionary, Second Edition, p. 871 (Month Unknown).

*Primary Examiner*—Prince Willis, Jr.
*Assistant Examiner*—Alan D. Diamond
*Attorney, Agent, or Firm*—Wayne W. Rupert

[57] ABSTRACT

A magnetorheological material containing a carrier fluid and a magnetically active particle. The particle has been modified so that the surface of the particle is substantially free of contamination products. The contamination products are removed from the surface of the particle by abrader processing, chemical treatment or a combination thereof. Magnetorheological materials prepared using the particles from which contamination products have been removed exhibit significantly enhanced magnetorheological effects.

29 Claims, 1 Drawing Sheet

MAGNETORHEOLOGICAL MATERIALS UTILIZING SURFACE-MODIFIED PARTICLES

This is a continuation-in-part of application(s) Ser. No. 07/959,687 filed Oct. 30, 1992 now abandoned.

FIELD OF THE INVENTION

The present invention relates to certain fluid materials which exhibit substantial increases in flow resistance when exposed to magnetic fields. More specifically, the present invention relates to magnetorheological materials that utilize a surface-modified particle component in order to enhance yield strength.

BACKGROUND OF THE INVENTION

Fluid compositions which undergo a change in apparent viscosity in the presence of a magnetic field are commonly referred to as Bingham magnetic fluids or magnetorheological materials. Magnetorheological materials normally are comprised of ferromagnetic or paramagnetic particles, typically greater than 0.1 micrometers in diameter, dispersed within a carrier fluid and in the presence of a magnetic field, the particles become polarized and are thereby organized into chains of particles within the fluid. The chains of particles act to increase the apparent viscosity or flow resistance of the overall material and in the absence of a magnetic field, the particles return to an unorganized or free state and the apparent viscosity or flow resistance of the overall material is correspondingly reduced. These Bingham magnetic fluid compositions exhibit controllable behavior similar to that commonly observed for electrorheological materials, which are responsive to an electric field instead of a magnetic field.

Both electrorheological and magnetorheological materials are useful in providing varying damping forces within devices, such as dampers, shock absorbers and elastomeric mounts, as well as in controlling torque and or pressure levels in various clutch, brake and valve devices. Magnetorheological materials inherently offer several advantages over electrorheological materials in these applications. Magnetorheological fluids exhibit higher yield strengths than electrorheological materials and are, therefore, capable of generating greater damping forces. Furthermore, magnetorheological materials are activated by magnetic fields which are easily produced by simple, low voltage electromagnetic coils as compared to the expensive high voltage power supplies required to effectively operate electrorheological materials. A more specific description of the type of devices in which magnetorheological materials can be effectively utilized is provided in copending U.S. application Ser. Nos. 07/900,571 and 07/900,567 entitled "Magnetorheological Fluid Dampers" and "Magnetorheological Fluid Devices," respectively, both filed on Jun. 18, 1992, the entire contents of which are incorporated herein by reference.

Magnetorheological or Bingham magnetic fluids are distinguishable from colloidal magnetic fluids or ferrofluids. In colloidal magnetic fluids the particles are typically 5 to 10 nanometers in diameter. Upon the application of a magnetic field, a colloidal ferrofluid does not exhibit particle structuring or the development of a resistance to flow. Instead, colloidal magnetic fluids experience a body force on the entire material that is proportional to the magnetic field gradient. This force causes the entire colloidal ferrofluid to be attracted to regions of high magnetic field strength.

Magnetorheological fluids and corresponding devices have been discussed in various patents and publications. For example, U.S. Pat. No. 2,575,360 provides a description of an electromechanically controllable torque-applying device that uses a magnetorheological material to provide a drive connection between two independently rotating components, such as those found in clutches and brakes. A fluid composition satisfactory for this application is stated to consist of 50% by volume of a soft iron dust, commonly referred to as "carbonyl iron powder", dispersed in a suitable liquid medium such as a light lubricating oil.

Another apparatus capable of controlling the slippage between moving parts through the use of magnetic or electric fields is disclosed in U.S. Pat. No. 2,661,825. The space between the moveable parts is filled with a field responsive medium. The development of a magnetic or electric field flux through this medium results in control of resulting slippage. A fluid responsive to the application of a magnetic field is described to contain carbonyl iron powder and light weight mineral oil.

U.S. Pat. No. 2,886,151 describes force transmitting devices, such as clutches and brakes, that utilize a fluid film coupling responsive to either electric or magnetic fields. An example of a magnetic field responsive fluid is disclosed to contain reduced iron oxide powder and a lubricant grade oil having a viscosity of from 2 to 20 centipoises at 25° C.

The construction of valves useful for controlling the flow of magnetorheological fluids is described in U.S. Pat. Nos. 2,670,749 and 3,010,471. The magnetic fluids applicable for utilization in the disclosed valve designs include ferromagnetic, paramagnetic and diamagnetic materials. A specific magnetic fluid composition specified in U.S. Pat. No. 3,010,471 consists of a suspension of carbonyl iron in a light weight hydrocarbon oil. Magnetic fluid mixtures useful in U.S. Pat. No. 2,670,749 are described to consist of a carbonyl iron powder dispersed in either a silicone oil or a chlorinated or fluorinated suspension fluid.

Various magnetorheological material mixtures are disclosed in U.S. Pat. No. 2,667,237. The mixture is defined as a dispersion of small paramagnetic or ferromagnetic particles in either a liquid, coolant, antioxidant gas or a semi-solid grease. A preferred composition for a magnetorheological material consists of iron powder and light machine oil. A specifically preferred magnetic powder is stated to be carbonyl iron powder with an average particle size of 8 micrometers. Other possible carrier components include kerosene, grease, and silicone oil.

U.S. Pat. No. 4,992,190 discloses a rheological material that is responsive to a magnetic field. The composition of this material is disclosed to be magnetizable particles and silica gel dispersed in a liquid carrier vehicle. The magnetizable particles can be powdered magnetite or carbonyl iron powders with insulated reduced carbonyl iron powder, such as that manufactured by GAF Corporation, being specifically preferred. The liquid carrier vehicle is described as having a viscosity in the range of 1 to 1000 centipoises at 100° F. Specific examples of suitable vehicles include Conoco LVT oil, kerosene, light paraffin oil, mineral oil, and silicone oil. A preferred carrier vehicle is silicone oil having a viscosity in the range of about 10 to 1000 centipoise at 100° F.

In many demanding applications for magnetorheological materials, such as dampers or brakes for automobiles or trucks, it is desirable for the magnetorheological material to exhibit a high yield stress so as to be capable of tolerating the large forces experienced in these types of applications. It has been found that only a nominal increase in yield stress of a given magnetorheological material can be obtained by selecting among the different iron particles traditionally utilized in magnetorheological materials. In order to increase the yield stress of a given magnetorheological material, it is typically necessary to increase the volume fraction of magnetorheological particles or to increase the strength of the applied magnetic field. Neither of these techniques is desirable since a high volume fraction of the particle component can add significant weight to a magnetorheological device, as well as increase the overall off-state viscosity of the material, thereby restricting the size and geometry of a magnetorheological device capable of utilizing that material, and high magnetic fields significantly increase the power requirements of a magnetorheological device.

A need therefore exists for a magnetorheological particle component that will independently increase the yield stress of a magnetorheological material without the need for an increased particle volume fraction or increased magnetic field.

SUMMARY OF THE INVENTION

The present invention is a magnetorheological material comprising a carrier fluid and a magnetically active particle wherein the particle has been modified so that the surface of the particle is substantially free of contamination products such as corrosion products. The formation of corrosion products on the surface of a magnetically active particle results from both chemical and electrochemical reactions of the particle's surface with water and atmospheric gases, as well as with electrolytes and particulates or contaminants that are either present in the atmosphere or left as a residue during particle preparation or processing. Corrosion products can either be compact and strongly adherent to the surface of the metal or loosely bound to the surface of the metal and can be in the form of a powder, film, flake or scale. The most common types of corrosion products include various forms of a metallic oxide layer, which are sometimes referred to as rust, scale or mill scale.

It has presently been discovered that the yield stress exhibited by a magnetorheological material can be significantly enhanced by the removal of contamination products from the surface of the magnetically active particles. Contamination products can be efficiently removed from the surface of metallic particles through abrader processing, chemical treatment or a combination thereof. In order to be effective, these techniques must be employed during the preparation of the magnetorheological material (in situ) or immediately prior to either the preparation of the magnetorheological material or the application of a protective coating. Abrader processing involves the physical or mechanical removal of the contamination products by impacting the surface of the magnetically active particles at a high velocity with an abrasive media. This abrasive media can either be an abrasive additive to the magnetorheological material or a form of grinding media used as a processing aid.

Chemical treatment methods or techniques applicable to the removal of contamination products during the preparation of the magnetorheological material include acid etching, cleaning or pickling; alkaline cleaning; electrolytic cleaning; ultrasonic cleaning and combinations thereof. Additional chemical treatment methods applicable to the removal of the contamination products prior to preparing the magnetorheological material include metal reduction or reactive gas processes, plasma cleaning, ion etching, sputter cleaning and combinations thereof.

The types of barrier coatings that are effective in protecting the surface of the particles can be comprised of nonmagnetic metals, ceramics, high performance thermoplastics, thermosetting polymers and combinations thereof. In order to effectively protect the surface of the particle from recontamination by a contamination product, it is necessary that this coating or layer substantially encase or encapsulate the particle.

DETAILED DESCRIPTION OF THE INVENTION

Figure 1:
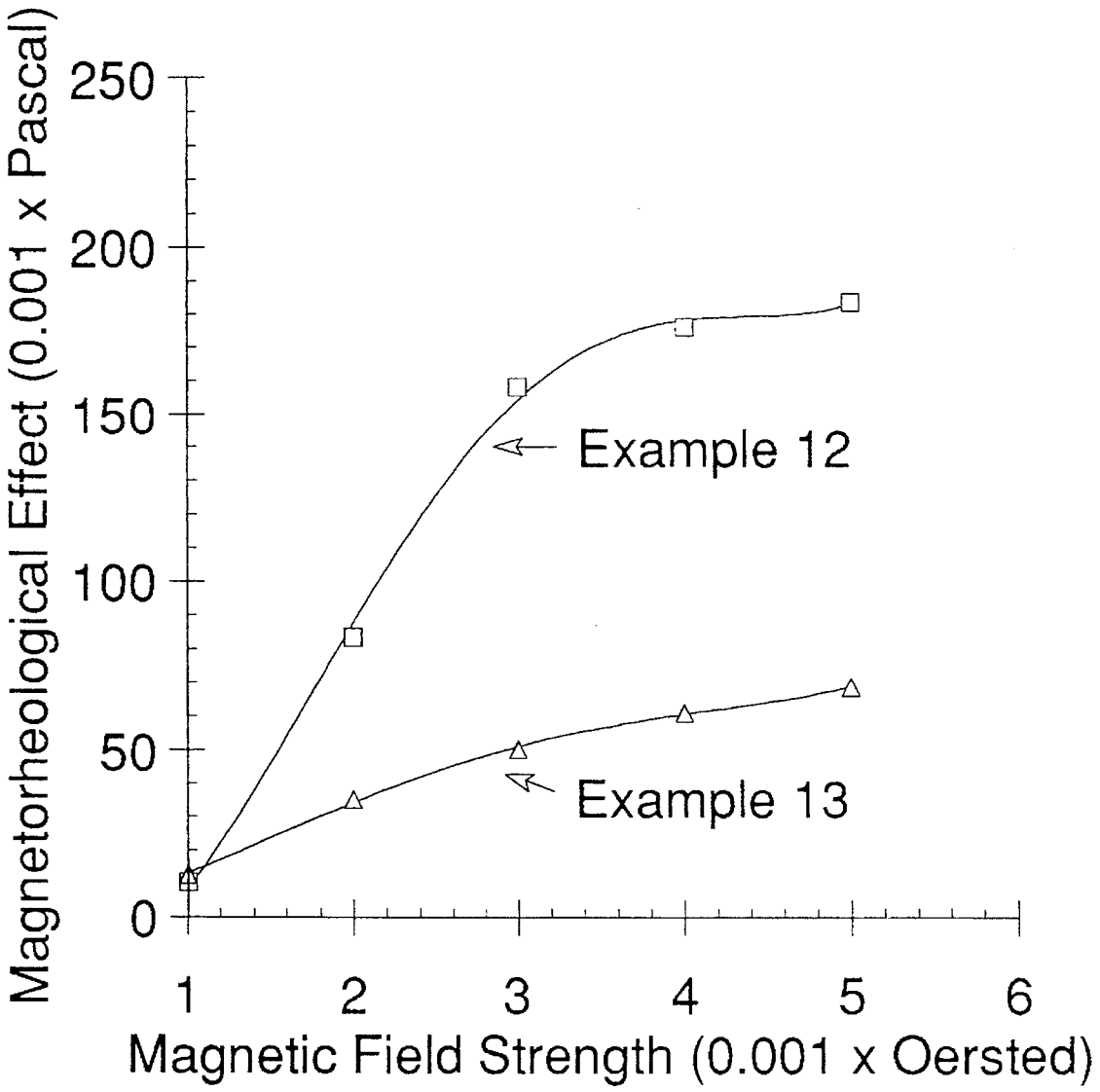
FIG. 1 is a plot of magnetorheological effect at 25° C. as a function of magnetic field strength for magnetorheological materials prepared in accordance with Example 12 and comparative Example 13.

The present invention relates to a magnetorheological material comprising a carrier fluid and a particle component wherein the particle component has been modified so that the surface of the particle component is substantially free of contamination products.

The contamination products can essentially be any foreign material present on the surface of the particle and the contamination products are typically corrosion products. As stated above, the formation of corrosion products on the surface of a magnetically active particle results from both chemical and electrochemical reactions of the particle's surface with water and atmospheric gases, as well as with electrolytes and particulates or contaminants that are either present in the atmosphere or left as a residue during particle preparation or processing. Examples of atmospheric gases involved in this surface degradation process include $O_2$, $SO_2$, $H_2S$, $NH_3$, $NO_2$, NO, $CS_2$, $CH_3SCH_3$, and COS. Although a metal may resist attack by one or more of these atmospheric gases, the surface of a metal is typically reactive towards several of these gases. Examples of chemical elements contaminating the surface of metal particles resulting from known powder processing techniques and methods include carbon, sulfur, oxygen, phosphorous, silicon and manganese. Examples of atmospheric particulates or contaminants involved in the formation of corrosion products on various metals include dust, water or moisture, dirt, carbon and carbon compounds or soot, metal oxides, $(NH_4)SO_4$, various salts (i.e., NaCl, etc.) and corrosive acids, such as hydrochloric acid, sulfuric acid, nitric acid and chromic acid. It is normal that metallic corrosion takes place in the presence of a combination of several of these atmospheric gases and contaminants. The presence of solid particulates, such as dust, dirt or soot on the surface of a metal increases the rate of degradation because of their ability to retain corrosive reactants, such as moisture, salts and acids. A more detailed discussion of the atmospheric corrosion of iron and other metals is provided by H. Uhlig and R. Revie in "Corrosion and Corrosion Control," (John Wiley & Sons, New York, 1985), the entire content of which is incorporated herein by reference.

The inherent degradation of the surface of a metal exposed to the atmosphere typically continues until either the corrosion product completely encompasses or encapsulates the particle or the entire bulk of the particle has reacted with the contaminants. Corrosion products can either be compact and strongly adherent to the surface of the metal or loosely bound to the surface of the metal as a powder, film, flake or scale. The most common types of corrosion products include various forms of a metallic oxide layer, which are sometimes referred to as rust, scale or mill scale.

The present invention is based on the discovery that the removal of contamination products from the surface of a magnetically polarizable particle causes the particle to be particularly effective in creating a magnetorheological material which is capable of exhibiting high yield stresses. Contamination products can be efficiently removed from the surface of metallic particles through abrader processing, chemical treatment or a combination thereof. In order to be effective, these techniques must be employed during the preparation of the magnetorheological material (in situ) or immediately prior to either the preparation of the magnetorheological material or the application of a particle barrier layer or coating.

Abrader processing involves the physical or mechanical removal of the contamination products resulting from impacting the surface of the magnetically active particles at a high velocity with an abrasive media. This abrasive media can either be an abrasive additive to the magnetorheological material or a form of grinding media used only as a processing aid.

The abrasive additive of the invention must be a material capable of sufficiently abrading a magnetorheological particle so as to substantially remove the contamination products from the surface of the particle. The abrasive additive must, therefore, possess a substantial degree of hardness or roughness so as to effectively abrade the surface of the magnetorheological particle. Various types of abrasive materials capable of removing contamination products from the surface of a metal are well known to those skilled in the art of tribology or superabrasives and can be utilized as abrasive additives in the invention. The abrasive additives of the invention are typically in the form of a powder and can be comprised of various materials such as the oxides of aluminum, chromium, zirconium, hafnium, titanium, silicon, and magnesium; the carbides, nitrides and borides of aluminum, silicon and boron; and cermets, such as WC-Co and Ni-Cr-$Al_2O_3$, as well as combinations thereof. Specific examples of abrasive additives include diamond dust, garnet, corundum, alumina, black mineral slag, $Cr_2O_3$, $HfO_2$, $TiO_2$, MgO, glass, sand, silica, aluminum silicates, pumice, rouge, emery, feldspar, SiC, $B_4C$, BN, $Si_3N_4$, AlN, cerium oxide, and fused alumina, as well as other refractory or ceramic abrasives.

Iron oxides have also been found to be effective as abrasive additives for purposes of the present invention. Specifically, it has been found that the relatively hard iron oxides can be utilized in combination with relatively soft iron powders such that the contamination products are removed from the surface of the iron by the iron oxides. It should be noted that although used in relatively minor amounts in the overall magnetorheological material, the iron oxides are magnetically active and also function as an additional magnetorheological particle in combination with the iron. The iron oxide includes all known pure iron oxides, such as $Fe_2O_3$ and $Fe_3O_4$, well as those containing small amounts of other elements, such as manganese, zinc or barium. Specific examples of iron oxide include ferrites and magnetites with ferrites being preferred.

The silica useful as an abrasive additive in the invention must be hydrophobic. In other words, the surface of the silica must be treated so as to contain a minimal amount of hydroxyl funtionality and the silica must be relatively free of adsorbed moisture. It is important that the surface of the silica be chemically treated to be hydrophobic since it has been found that conventional drying of otherwise hydrophilic silica (e.g., silica gel such as that supplied by PPG Industries under the trade name HI-SIL 233) is not sufficient to render the silica hydrophobic for purposes of the invention. Although not completely understood, it is believed that an excess of adsorbed moisture and/or hydroxyl functionality prevents the hydrophilic silica from sufficiently abrading the surface of the particle component.

The hydrophobic silica of the invention can be prepared by reacting the hydroxyl groups on the surface of the silica with various organofunctional monomeric silanes or silane coupling agents, such as hydroxysilanes, acyloxysilanes, epoxysilanes, oximesilanes, alkoxysilanes, chlorosilanes and aminosilanes as is known in the art. The hydroxyl groups on the surface of the silica may also be reacted with polymeric compounds such as silicone oils, mineral oils and paraffin oils. The modification of the surface of silica with various materials to render the silica hydrophobic is described by W. Noll in "Chemistry and Technology of Silicones," Academic Press, Inc., New York, 1968 and by E. P. Plueddemann in "Silane Coupling Agents," Plenum Press, New York, 1982, both the entire disclosures of which are incorporated herein by reference. Specific examples of hydrophobic silicas include those commercially obtainable under the trade names AEROSIL and CABOSIL from Degussa Corporation and Cabot Corporation, respectively.

The preferred abrasive additives of the present invention include hydrophobic silica, iron oxides, and alumina because of their potential to contribute to the formation of a thixotropic network as described hereinafter. Iron oxides are specifically preferred due to their magnetorheological activity and relatively high specific gravity.

The diameter of the abrasive additives utilized herein can range from about 0.001 to 50.0 μm, preferably from about 0.001 to 20.0 μm with about 0.001 to 5.0 μm being specifically preferred. These abrasive additives are typically utilized in an amount ranging from about 0.05 to about 10.0, preferably from about 0.1 to about 5.0, with about 0.2 to about 3.0 percent by volume of the total magnetorheological material being especially preferred.

In order to be effective, the abrasive additive must be caused to impact the surface of a magnetorheological particle with a kinetic energy high enough to efficiently remove contamination products from the surface of the particle. This can be carried out during the preparation of the magnetorheological material (in situ), immediately prior to the preparation of the magnetorheological material or immediately prior to the application of a protective coating to the particle. If carried out during the preparation of the magnetorheological material, the abrasive additive is combined with the magnetotheological particle component, carrier fluid and any optional ingredients, and the resulting combination of ingredients is initially mixed by hand with a spatula or the like and then more thoroughly mixed with a homogenizer, mechanical mixer, mechanical shaker, or an appropriate milling device such as a ball mill, sand mill, attritor mill, colloid mill, paint mill, pebble mill, shot mill, vibration mill, roll mill, horizontal small media mill, or the like (all hereinafter collectively referred to as "mixing devices").

It is the mass of the abrasive additive, as well as the velocity achieved by this additive during the mixing or dispersing process that determines the magnitude of kinetic energy available for the removal of contamination products from the magnetorheological particles. The velocity of the abrasive additive is dependent upon the viscosity of the magnetorheological material and the speed at which the mixing device is operated. For a typical magnetorheological material with a viscosity less than about 1000 centipoise at 25° C., sufficient velocity is achieved by the abrasive additive to effectively remove contamination products from the magnetorheological particles when the mixing device is operated with a minimum tip speed of about 50 ft/min. The ingredients must be mixed together or dispersed for a sufficient length of time to substantially remove contamination products from the surface of the magentorheological particle. An increase in the velocity of the abrasive additive will usually result in a decrease in the required mixing or dispersion time. In general, the ingredients should be mixed for a period of time typically ranging from about 1 minute to 24 hours, preferably ranging from about 5 minutes to 18 hours. A certain amount of experimentation may be required to determine the optimum parameters that will allow for efficient removal of contamination products from a particular magnetorheological particle. Even if the above guidelines with respect to mixing speed and mixing time are not precisely followed, the mere presence of an abrasive additive during the preparation and utilization of a magnetorheological material has been found to be beneficial in that contamination products are substantially reduced. The present invention therefore also relates to an electrorheological material comprising a carrier fluid, a magnetically active particle, and an abrasive additive wherein the particle has a diameter ranging from about 0.1 to 500 μm. The abrasive additive to be included in the electrorheological material can be any of the abrasive additives described above and is typically utilized in an amount ranging from about 0.05 to 10.0, preferably from about 0.1 to 5.0, with about 0.2 to 3.0 percent by volume of the total magnetorheological material being especially preferred.

Confirmation of the substantial removal of contamination products from the surface of a magnetorheological particle may be obtained by utilizing various material characterization techniques known to those skilled in the art of analytical chemistry and surface analysis. Examples of several known techniques for the quantitative/qualitative detection of atomic and/or molecular species include neutron activation analysis; scanning ion mass spectrometry (SIMS); x-ray methods, such as x-ray powder diffraction, x-ray fluorescence spectroscopy (XRF), x-ray photoelectron spectroscopy (XPS) and electron spectroscopy for chemical analysis (ESCA); and microscopy methods, such as scanning tunneling microscopy (STM), scanning electron microscopy (SEM), scanning auger microanalysis (SAM), and electron probe microanalysis (EPMA). Microscopy of powder samples are typically performed using an ultramicrotomy procedure well known to those skilled in the art.

If the contamination products are to be removed from the surface of the magnetorheological particle immediately prior to either the preparation of the magnetorheological material or the application of a protective coating, the above mixing procedure is followed except that only the magnetorheological particle and abrasive additive are utilized. After the mixing procedure, the abraded particle may be immediately combined with the other ingredients to prepare a magnetorheological material or immediately coated with a protective coating to prevent the reformation of corrosion products. By "immediately," it is typically meant that the abraded particle is combined with the other ingredients of the magnetorheological material or coated with a protective coating within no more than about 60 minutes, preferably within no more than about 30 minutes, after completion of the mixing procedure, unless the particles are stored for a longer time period under a contaminant-free atmosphere.

Contamination products can also be removed from the particle component through abrader processing using various grinding media as a processing aid. This form of abrader processing can also be performed during the preparation of the magnetorheological material or immediately prior to either preparing the magnetorheological material or applying a protective coating to the particles. The type of grinding media and the nature of the corresponding equipment needed to perform this abrading process are described as those capable of reducing or changing the diameter or size of the particle component. Specific types of appropriate media and equipment are well known to those skilled in the art of manufacturing paints and coatings. Devices such as homogenizers, mechanical mixers and shakers that do not utilize a milling-type process, and are therefore not capable of reducing particle size, provide inadequate removal of contamination products from the surface of magnetorheological particles for purposes of the present invention, unless an abrasive additive as previously described is utilized in combination with the device.

Examples of common grinding media appropriate for use as a processing aid include balls, beads, pellets, pebbles, grit or shot comprised of various materials including stainless steel, ceramic, porcelain, flint, high carbon steel, high manganese steel, cast nickel alloy, low carbon forged steel, tungsten carbide, glass, zirconium silicate, zirconium oxide, and aluminum oxide. Examples of common media milling devices or mills that utilize these types of grinding media include sand mills, ball mills, attritor mills, pebble mills, shot mills, vibration mills and horizontal small media mills. In addition, the grinding media may be in the form of a wheel, disc or blade, such as that typically used in roll mills. A more complete description of media mills is provided by G. Tank and T. Patten in "Industrial Paint Finishing Techniques and Processes" (Ellis Horwood Limited, West Sussex, England, 1991) and "Paint Flow and Pigment Dispersion" (2nd edition, John Wiley & Sons, New York, 1979), respectively, the entire contents of which are incorporated herein by reference.

As is the case with the abrasive additive described above, the grinding media must be caused to impact the surface of a magnetorheological particle with a kinetic energy high enough to sufficiently remove contamination products from the surface of the particle. It is the mass of the grinding media, as well as the velocity achieved by this media during the milling process that determines the magnitude of kinetic energy available for the removal of contamination products from the magnetorheological particles. The velocity of the grinding media is dependent upon the viscosity of the magnetorheological material and the speed at which the milling device is operated. For a typical magnetorheological material with a viscosity less than about 1000 centipoise at 25° C., sufficient velocity is achieved by the grinding media to effectively remove contamination products from the magnetorheological particles when the milling device is operated with a minimum tip speed of about 300 ft/min. The ingredients must be mixed together or dispersed for a sufficient length of time to substantially remove contamination products from the surface of the magentorheological particle. An increase in the velocity of the grinding media will usually result in a decrease in the required milling time. In general, the ingredients should be mixed for a period of time typically ranging from about 1 hour to 48 hours, preferably ranging from about 2 hours to 24 hours. A certain amount of experimentation may be required to determine the optimum parameters that will allow for efficient removal of contamination products from a particular magnetorheological particle.

It should be noted that abrasive additives can be utilized in combination with grinding media and, in this case, the efficiency of the corresponding milling device may be increased resulting in a lesser amount of both time and speed of the milling device needed to remove the contamination products from the surface of the magnetorheological particle.

Removal of contamination products from the surface of the magnetorheological particle can also be accomplished through chemical treatment techniques. The chemical treatment can be carried out during the preparation of the magnetorheological material (in situ), immediately prior to the preparation of the magnetorheological material or immediately prior to the application of a protective coating to the particle. Chemical treatment methods or techniques applicable to the removal of contamination products during the preparation of the magnetorheological material include acid cleaning, alkaline cleaning, electrolytic cleaning, ultrasonic cleaning and combinations thereof, such as the combination of electrolytic cleaning and alkaline cleaning commonly utilized in the electroplating industry. Examples of alkaline cleaners useful in the invention include alkali metal orthophosphates, condensed phosphates, hydroxides, carbonates, bicarbonates, silicates and borates. Alkaline cleaners are typically utilized in combination with a surfactant as is known in the art.

Examples of common acid cleaners useful in the invention include organic acids, such as citric, tartaric, acetic, oxalic and gluconic acid, acid salts, such as sodium phosphate, ammonium persulfate, sodium acid sulfate and bifluroride salts, and inorganic acids, such as sulfuric acid, phosphoric acid and hydrochloric acid.

Acid and alkaline cleaning during the preparation of the magnetorheological material can be carried out by adding an acid or alkaline cleaner to the ingredients utilized to prepare the magnetorheological material and then thoroughly mixing the ingredients first by hand with a spatula or the like and then with a mechanical mixing device. The acid or alkaline cleaner is typically utilized in an amount ranging from about 0.1 to 5.0, preferably from about 0.5 to 3.0, percent by weight of the particle component.

Electrolytic cleaning or electrocleaning during the preparation of the magnetorheological material is typically carried out by applying an electric current to the material in order to produce vigorous gassing on the surface of the particles and promote the release of contaminants. Electrocleaning can be either cathodic or anodic in nature. This technique is generally used in conjunction with acid or alkaline cleaning as previously described.

Ultrasonic cleaning during the preparation of the magnetorheological material is typically carried out by passing sound waves at high frequencies through the material. These ultrasonic waves create tiny gas bubbles throughout the carrier component, which vigorously cleans the surface of the particles. This technique is often used in conjunction with acid or alkaline cleaning as previously described.

The chemical treatment methods that are applicable to the removal of contamination products immediately prior to either preparing the magnetorheological material or applying a protective coating include the techniques described above for in situ treatment, as well as metal reduction; plasma cleaning; ion etching; sputter cleaning and combinations thereof. Metal reduction typically involves the reduction of the metal particle's surface through a reaction with a gaseous molecule, such as hydrogen, at elevated temperatures.

A thorough description of the chemical treatment techniques described above is provided by B. Bhushan and B. Gupta in "Handbook of Tribology," McGraw-Hill, Inc., New York, 1991 (hereinafter referred to as Bhushan), the entire contents of which are incorporated herein by reference.

The preferred chemical treatment method of the invention is the utilization of acid cleaners or alkaline cleaners during the preparation of the magnetorheological material (in situ). The present invention therefore also relates to a magnetorheological material comprising a carrier fluid, a magnetically active particle, and an acid cleaner or an alkaline cleaner wherein the particle has a diameter ranging from about 0.1 to 500 μm. The acid or alkaline cleaner useful in the magnetorheological material can be any of the acid or alkaline cleaners described above and is typically utilized in an amount ranging from about 0.1 to 5.0, preferably from about 0.5 to 3.0 percent by weight of the particle component.

For purposes of the present invention, abrasive additives, acid cleaners and alkaline cleaners are herein collectively referred to as contaminant-removing additives.

As stated above, immediately after removing the contamination products from the particle's surface through either abrader processing, chemical treatment or a combination thereof, a protective coating can be applied to the surface of the particle. In order to effectively protect the surface of the particle from recontamination by a contamination product, it is necessary that the protective coating substantially, preferably entirely, encase or encapsulate the particle. Protective coatings that substantially encapsulate the particle are to be distinguished from insulation coatings, such as those presently found on carbonyl iron powder such as the insulated reduced carbonyl iron powder supplied by GAF Corporation under the designations "GQ-4" and "GS-6."

The insulation coatings found on insulated reduced carbonyl iron are intended to prevent particle-to-particle contact and are simply formed by dusting the particles with silica gel particulates. Insulation coatings therefore do not substantially encapsulate the particle so as to prevent the formation of contamination products. The sporadic coverage of a particle's surface by an insulation coating can be seen in the scanning electron micrographs presented in the article by J. Japka entitled "Iron Powder for Metal Injection Molding" (*International Journal of Powder Metallurgy*, 27(2), 107–114), the entire contents of which are incorporated herein by reference. Incomplete coverage of the particle's surface by a coating typically will result in the accelerated formation of contamination products through the process described above for solid atmospheric particles, such as dust and soot. Iron oxide, previously described in the literature as being useful as an insulation coating, cannot be used as a protective coating for purposes of the present invention because iron oxide itself is a corrosion product.

The protective coatings of the invention that are effective in preventing the formation of contamination products on the surface of magnetorheological particles can be composed of a variety of materials including nonmagnetic metals, ceramics, thermoplastic polymeric materials, thermosetting polymers and combinations thereof. Examples of thermosetting polymers useful for forming a protective coating include polyesters, polyimides, phenolics, epoxies, urethanes, rubbers and silicones, while thermoplastic polymeric materials include acrylics, cellulosics, polyphenylene sulfides, polyquinoxilines, polyetherimides and polybenzimidazoles. Typical nonmagnetic metals useful for forming a protective coating include refractory transition metals, such as titanium, zirconium, hafnium, vanadium, niobium, tantulum, chromium, molybdenum, tungsten, copper, silver, gold, and lead, tin, zinc, cadmium, cobalt-based intermetallic alloys, such as Co-Cr-W-C and Co-Cr-Mo-Si, and nickel-based intermetallic alloys, such as Ni-Cu, Ni-Al, Ni-Cr, Ni-Mo-C, Ni-Cr-Mo-C, Ni-Cr-B-Si-C, and Ni-Mo-Cr-Si. Examples of ceramic materials useful for forming a protective coating include the carbides, nitrides, borides, and silicides of the refractory transition metals described above; nonmetallic oxides, such as $Al_2O_3$, $Cr_2O_3$, $ZrO_3$, $HfO_2$, $TiO_2$, $SiO_2$, BeO, MgO, and $ThO_2$; nonmetallic nonoxides, such as $B_4C$, SiC, BN, $Si_3N_4$, AlN, and diamond; and various cermets.

A thorough description of the various materials typically utilized to protect metal surfaces from the growth of corrosion products is provided by C. Munger in "Corrosion Prevention by Protective Coatings" (National Association of Corrosion Engineers, Houston, Texas, 1984), the entire content of which is incorporated herein by reference. A commercially available iron powder that is encapsulated with a polyethefimide coating is manufactured under the trade name ANCOR by Hoeganaes.

The protective coatings of the invention can be applied by techniques or methods well known to those skilled in the art of tribology. Examples of common coating techniques include both physical deposition and chemical vapor deposition methods. Physical deposition techniques include both physical vapor deposition and liquid or wetting methods. Physical vapor deposition methodology includes direct, reactive, activated reactive and ion-beam assisted evaporation; DC/RF diode, alternating, triode, hollow cathode discharge, sputter ion, and cathodic arc glow discharge ion plating; direct, cluster ion and ion beam plating; DC/RF diode, triode and magnetron glow discharge sputtering; and single and dual ion beam sputtering. Common physical liquid or wetting methodology includes air/airless spray, dip, spin-on, electrostatic spray, spray pyrolysis, spray fusion, fluidized bed, electrochemical deposition, chemical deposition such as chemical conversion (e.g., phosphating, chromating, metalliding, etc.), electroless deposition and chemical reduction; intermetallic compounding, and colloidal dispersion or sol-gel coating application techniques. Chemical vapor deposition methodology includes conventional, low pressure, laser-induced, electron-assisted, plasma-enhanced and reactive-pulsed chemical vapor deposition, as well as chemical vapor polymerization. A thorough discussion of these various coating processes is provided in Bhushan.

Due to the additional production costs associated with removing the corrosion products from the surface of the particles prior to preparing a magnetorheological material, the preferred abrader processing and chemical treatment methods of the invention include those performed during the preparation of the magnetorheological material. In this regard, abrader processing is generally preferable over chemical treatment.

In instances where the contaminant layer of a particle is either not sufficiently removed from the surface of the particle by the above methods or the removal of the contaminant layer is deemed nonviable due to economic considerations, application specifications or other reasons, the subsequent growth of any existing contaminant layer can be eliminated or minimized through the application of the protective coatings described above. In this case, the protective coating applied to a particle in an "as received" condition prevents the further degradation of the properties associated with the particle. This protective coating may also provide additional advantages to the formulated magnetorheological material by reducing wear associated with seals and other device components that are in contact with the magnetorheological material, as well as increasing the mechanical durability of the particle component.

Since the protective coatings of the present invention can be applied to a particle whose contaminant layer has been substantially removed or to a particle that has an existing contaminant layer, the present invention relates to a magnetorheological material comprising a carrier fluid and a magnetically active particle wherein the particle is substantially encapsulated or coated with a protective coating and has a diameter ranging from about 0.1 to 500 μm. The protective coating applied to the surface of the particle of the magnetorheological material may be any of the protective coatings described above and may be applied by any of the methods described above. It is preferred that the protective coating cover or encapsulate at least about 90 percent, preferably from about 95 to 100 percent, and most preferably from about 98 to 100 percent of the surface of the particle in order to provide adequate protection from corrosion and wear. As described above, protective coatings that substantially encapsulate a particle are distinguishable from traditional insulation coatings such as those presently found on carbonyl iron powder.

The magnetically active particle component to be modified according to the present invention can be comprised of essentially any solid which is known to exhibit magnetorheological activity and which can inherently form a contamination product on its surface. Typical particle components useful in the present invention are comprised of, for example, paramagnetic, superparamagnetic, or ferromagnetic compounds. Specific examples of particle components useful in the present invention include particles comprised of materials such as iron, iron nitride, iron carbide, carbonyl iron, chromium dioxide, low carbon steel, silicon steel, nickel, cobalt, and mixtures thereof. In addition, the particle component can be comprised of any of the known alloys of iron, such as those containing aluminum, silicon, cobalt, nickel, vanadium, molybdenum, chromium, tungsten, manganese and/or copper. The particle component can also be comprised of the specific iron-cobalt and iron-nickel alloys described in the U.S. patent application entitled "Magnetorheological Materials Based on Alloy Particles" filed concurrently herewith by Applicants J. D. Carlson and K. D. Weiss and also assigned to the present assignee, the entire disclosure of which is incorporated herein by reference.

The particle component is typically in the form of a metal powder which can be prepared by processes well known to those skilled in the art. Typical methods for the preparation of metal powders include the reduction of metal oxides, grinding or attrition, electrolytic deposition, metal carbonyl decomposition, rapid solidification, or smelt processing. Various metal powders that are commercially available include straight iron powders, reduced iron powders, insulated reduced iron powders, and cobalt powders. The diameter of the particles utilized herein can range from about 0.1 to 500 μm and preferably range from about 1.0 to 50 μm.

The preferred particles of the present invention are straight iron powders, reduced iron powders, iron-cobalt alloy powders and iron-nickel alloy powders.

The particle component typically comprises from about 5 to 50, preferably about 15 to 40, percent by volume of the total composition depending on the desired magnetic activity and viscosity of the overall material.

The carrier fluid of the magnetorheological material of the present invention can be any carrier fluid or vehicle previously disclosed for use in magnetorheological materials, such as the mineral oils, silicone oils and paraffin oils described in the patents set forth above. Additional carrier fluids appropriate to the invention include silicone copolymers white oils, hydraulic oils, chlorinated hydrocarbons, transformer oils, halogenated aromatic liquids, halogenated paraffins, diesters, polyoxyalkylenes, perflurorinated polyethers, flurorinated hydrocarbons, flurorinated silicones, and mixtures thereof. As known to those familiar with such compounds, transformer oils refer to those liquids having characteristic properties of both electrical and thermal insulation. Naturally occurring transformer oils include refined mineral oils that have low viscosity and high chemical stability. Synthetic transformer oils generally comprise chlorinated aromatics (chlorinated biphenyls and tfichlorobenzene), which are known collectively as "askarels", silicone oils, and esteric liquids such as dibutyl sebacates. The preferred carrier fluids of the present invention are silicone oils and mineral oils.

The carrier fluid of the magnetorheological material of the present invention should have a viscosity at 25° C. that is between about 2 and 1000 centipoise, preferably between about 3 and 200 centipoise, with a viscosity between about 5 and 100 centipoise being especially preferred. The carrier fluid of the present invention is typically utilized in an amount ranging from about 50 to 95, preferably from about 60 to 85, percent by volume of the total magnetorheological material.

Particle settling may be minimized in the magnetorheological materials of the present invention by forming a thixotropic network. A thixotropic network is defined as a suspension of particles that, at low shear rates, form a loose network or structure sometimes referred to as clusters or flocculates. The presence of this three-dimensional structure imparts a small degree of rigidity to the magnetorheological material, thereby reducing particle settling. However, when a shearing force is applied through mild agitation, this structure is easily disrupted or dispersed. When the shearing force is removed, this loose network is reformed over a period of time. A thixotropic network may be formed in the magnetorheological fluid of the present invention through the utilization of any known hydrogen-bonding thixotropic agents and/or colloidal additives. The thixotropic agents and colloidal additives, if utilized, are typically employed in an amount ranging from about 0.1 to 5.0, preferably from about 0.5 to 3.0, percent by volume relative to the overall volume of the magnetorheological fluid.

Examples of hydrogen-bonding thixotropic agents useful for forming a thixotropic network in the present invention include low molecular weight hydrogen-bonding molecules, such as water and other molecules containing hydroxyl, carboxyl or amine functionality, as well as medium molecular weight hydrogen-bonding molecules, such as silicone oligomers, organosilicone oligomers, and organic oligomers. Typical low molecular weight hydrogen-bonding molecules other than water include alcohols; glycols; alkyl amines, amino alcohols, amino esters, and mixtures thereof. Typical medium molecular weight hydrogen-bonding molecules include oligomers containing sulphonated, amino, hydroxyl, cyano, halogenated, ester, carboxylic acid, ether, and ketone moieties, as well as mixtures thereof.

Examples of colloidal additives useful for forming a thixotropic network in the present invention include hydrophobic and hydrophilic metal oxide and high molecular weight powders. Examples of hydrophobic powders include surface-treated hydrophobic fumed silica and organoclays. Examples of hydrophilic metal oxide or polymeric materials include silica gel, fumed silica, clays, and high molecular weight derivatives of caster oil, poly(ethylene oxide), and poly(ethylene glycol).

An additional surfactant to more adequately disperse the particle component may be optionally utilized in the present invention. Such surfactants include known surfactants or dispersing agents such as ferrous oleate and naphthenate, sulfonates, phosphate esters, glycerol monooleate, sorbitan sesquioleate, stearates, laurates, fatty acids, fatty alcohols, and the other surface active agents discussed in U.S. Pat. No. 3,047,507 (incorporated herein by reference). Alkaline soaps, such as lithium stearate and sodium stearate, and metallic soaps, such as aluminum tristearate and aluminum distearate can also be presently utilized as a surfactant. In addition, the optional surfactants may be comprised of steric stabilizing molecules, including fluoroaliphatic polymeric esters, such as FC-430 (3M Corporation), and titanate, aluminate or zirconate coupling agents, such as KEN-REACT® (Kenrich Petrochemicals, Inc.) coupling agents. Finally, a precipitated silica gel, such as that disclosed in U.S. Pat. No. 4,992,190 (incorporated herein by reference), can be used to disperse the particle component. In order to reduce the presence of moisture in the magnetorheological material, it is preferred that the precipitated silica gel, if utilized, be dried in a convection oven at a temperature of from about 110° C. to 150° C. for a period of time from about 3 to 24 hours.

The surfactant, if utilized, is preferably a "dried" precipitated silica gel, a fluoroaliphatic polymeric ester, a phosphate ester, or a coupling agent. The optional surfactant may be employed in an amount ranging from about 0.1 to 20 percent by weight relative to the weight of the particle component.

The magnetorheological materials of the present invention may also contain other optional additives such as lubricants or anti-wear agents, pour point depressants, viscosity index improvers, foam inhibitors, and corrosion inhibitors. These optional additives may be in the form of dispersions, suspensions or materials that are soluble in the carrier fluid of the magnetorheological material.

The preparation of magnetorheological materials according to the invention where contamination products are removed from the surface of the magnetorheological particle in Situ has previously been described. If contamination products are removed from the particle immediately prior to either the preparation of the magnetorheological material or the application of a protective coating, the magnetorheological materials of the present invention can be prepared by simply mixing together the carrier fluid, the pre-treated particle component, and any optional ingredients.

The ingredients of the magnetorheological materials may be initially mixed together by hand with a spatula or the like and then subsequently more thoroughly mixed with a homogenizer, mechanical mixer, mechanical shaker, or an appropriate milling device such as a ball mill, sand mill, attritor mill, colloid mill, paint mill, pebble mill, shot mill, vibration mill, roll mill, horizontal small media mill or the like, in order to create a more stable suspension. The mixing conditions for the preparation of a magnetorheological material utilizing a magnetorheological particle that has had contamination products previously removed can be somewhat less rigorous than the conditions required for the preparation and in situ removal of contamination products.

Evaluation of the mechanical properties and characteristics of the magnetorheological materials of the present invention, as well as other magnetorheological materials, can be obtained through the use of parallel plate and/or concentric cylinder couette rheometry. The theories which provide the basis for these techniques are adequately described by S. Oka in *Rheology, Theory and Applications* (volume 3, F. R. Eirich, ed., Academic Press: New York, 1960) the entire contents of which are incorporated herein by reference. The information that can be obtained from a rheometer includes data relating mechanical shear stress as a function of shear strain rate. For magnetorheological materials, the shear stress versus shear strain rate data can be modeled after a Bingham plastic in order to determine the dynamic yield stress and viscosity. Within the confines of this model the dynamic yield stress for the magnetorheological material corresponds to the zero-rate intercept of a linear regression curve fit to the measured data. The magnetorheological effect at a particular magnetic field can be further defined as the difference between the dynamic yield stress measured at that magnetic field and the dynamic yield stress measured when no magnetic field is present. The viscosity for the magnetorheological material corresponds to the slope of a linear regression curve fit to the measured data.

In a concentric cylinder cell configuration, the magnetorheological material is placed in the annular gap formed between an inner cylinder of radius $R_1$ and an outer cylinder of radius $R_2$, while in a simple parallel plate configuration the material is placed in the planar gap formed between upper and lower plates both with a radius, $R_3$. In these techniques either one of the plates or cylinders is then rotated with an angular velocity $\omega$ while the other plate or cylinder is held motionless. A magnetic field can be applied to these cell configurations across the fluid-filled gap, either radially for the concentric cylinder configuration, or axially for the parallel plate configuration. The relationship between the shear stress and the shear strain rate is then derived from this angular velocity and the torque, T, applied to maintain or resist it.

The following examples are given to illustrate the invention and should not be construed to limit the scope of the invention.

EXAMPLES 1 & 2

In Example 1, a magnetorheological material is prepared by slowly adding a total of 117.9 g of carbonyl iron powder (Sigma Chemical Company) to a mixture of 3.54 g of an 11N phosphoric acid solution, which is prepared using phosphoric acid (99%, Aldrich Chemical Company) and distilled water, and 28.29 g of 20 cstk mineral oil (DRAKEOL 10, Pennzoil Products Company). The temperature of the magnetorheological material is maintained during this initial mixing procedure within the temperature range of about 30° to 45° C. The fluid is initially mixed by hand with a spatula (low shear) and then more thoroughly dispersed into a homogeneous mixture through the use of a high speed disperserator (high shear) equipped with a 16-tooth rotary head. The weight amount of the chemically treated iron particles in the magnetorheological material is equivalent to a volume fraction of about 0.30. The magnetorheological material is stored in a polyethylene container.

In Example 2, a magnetorheological material is prepared according to the procedure described in Example 1. However, in this example the phosphoric acid solution is replaced with 3.54 g of an 11N sulfuric acid solution, which is prepared using sulfuric acid (95–98%, Aldrich Chemical Company) and distilled water. The amount of mineral oil is adjusted to maintain the particle volume fraction in the magnetorheological material at 0.30. The magnetorheological material is stored in a polyethylene container.

COMPARATIVE EXAMPLE 3

In Example 3, a magnetorheological material is prepared according to the procedure described in Example 1. However, in this example a total of 117.9 g of carbonyl iron powder (Sigma Chemical Company), 2.35 g of stearic acid (Aldrich Chemical Company) as a dispersant and 28.67 g of 20 cstk mineral oil (DRAKEOL 10, Pennzoil Products Company) are mixed together. The weight amount of untreated iron particles in the magnetorheological material is equivalent to a volume fraction of about 0.30. The conventional magnetorheological material is stored in a polyethylene container.

Magnetorheological Activity for Examples 1–3

The magnetorheological materials prepared in Examples 1, 2 and 3 are evaluated through the use of parallel plate rheometry. A summary of the magnetorheological effect observed for these magnetorheological materials at various magnetic field strengths and 25° C. is provided in Table 1. A significantly higher magnetorheological effect is observed for the magnetorheological materials utilizing particles wherein contamination products have been removed by chemical treatment (Examples 1 and 2) as compared to a magnetorheological material containing conventional untreated particles (Example 3). At a magnetic field strength of 5000 Oersted the magnetorheological effect exhibited by the magnetorheological materials containing the chemically treated particles is about 71% greater than that exhibited by a conventional magnetorheological material.

TABLE 1

| | | Magnetic Field Strength (Oersted) | | | | |
|---|---|---|---|---|---|---|
| | | 1000 | 2000 | 3000 | 4000 | 5000 |
| Magneto-rheological Effect (kPa) | Example 1 | 32.4 | 46.2 | 72.5 | 91.7 | 100.7 |
| | Example 2 | 10.0 | 38.0 | 65.4 | 80.3 | 94.5 |
| | Comparative Example 3 | 8.9 | 25.1 | 43.3 | 53.5 | 55.3 |

EXAMPLE 4

A magnetorheological material is prepared by mixing together a total of 123.2 g of carbonyl iron powder (Sigma Chemical Company), 2.46 g of stearic acid (Aldrich Chemical Company) as a dispersant and 34.20 g of 200 cstk silicone oil (Dow Corning Corporation). This weight amount of iron particles is equivalent to a volume fraction in the magnetorheological material of about 0.30. The fluid is made into a homogeneous mixture using an Union Process 01HD attritor mill equipped with a 110 $cm^3$ tank. The grinding media used in this attritor mill is in the form of stainless steel balls. This mill has the capability to reduce the mean size and distribution of the particle component when the impacting grinding media has high kinetic energy. This grinding media imparts sufficient kinetic energy to remove the contamination products from the particle component when the agitator shaft and arms of this mill are rotated at tip speed of about 300 ft./min. The maximum tip speed of this mill is measured to be about 600 ft./min. The magnetorheological material is aggressively milled in this abrader process over a 48-hour period with a tip speed of about 445 ft./min. The magnetorheological material is separated from the grinding media and stored in a polyethylene container.

COMPARATIVE EXAMPLE 5

A magnetorheological material is prepared according to the procedure described in Example 4. However, in this example the mill is operated with a tip speed of about 250 ft./min. over a 96-hour period. The rotation of the agitator shaft and arms at this angular speed does not impart sufficient kinetic energy to the stainless steel grinding media to remove the contamination products from the surface of particle component. The conventional magnetorheological material is separated from the grinding media and stored in a polyethylene container.

Magnetorheological Activity for Examples 4 & 5

The magnetorheological materials prepared in Examples 4 and 5 are evaluated through the use of parallel plate rheometry. A summary of the magnetorheological effect for these magnetorheological materials at various magnetic field strengths and 25° C. is provided in Table 2. A significantly higher magnetorheological effect is observed for the magnetorheological material utilizing particles wherein contamination products have been removed by stainless steel grinding media in an abrader process (Example 4) as compared to a magnetorheological material containing conventional particles (Example 5). At a magnetic field strength of 3000 Oersted the magnetorheological effect exhibited by the magnetorheological material containing the abrader process modified particles is about 69% greater than that exhibited by a conventional magnetorheological material.

TABLE 2

| | | Magnetic Field Strength (Oersted) | | |
|---|---|---|---|---|
| | | 1000 | 2000 | 3000 |
| Magneto-rheological Effect (kPa) | Example 4 | 19.1 | 43.0 | 84.3 |
| | Comparative Example 5 | 8.0 | 31.9 | 50.0 |

EXAMPLE 6

A magnetorheological material is prepared by adding together a total of 117.9 g of reduced iron powder (ATOMET 95G, Quebec Metal Powders Limited), 8.75 g of Mn/Zn ferrite powder (#73302-0, D. M. Steward Manufacturing Company) as an abrasive additive, 2.53 g polyoxyethylene/silicone graft copolymer (SILWET L7500, Union Carbide Chemicals and Plastics Company, Inc.) as a thixotropic agent and 29.13 g of 10 cstk silicone oil (L-45, Union Carbide Chemicals and Plastics Company, Inc.). The fluid is initially mixed by hand with a spatula (low shear) and then more thoroughly dispersed into a homogeneous mixture through the use of a high speed disperserator (high shear) equipped with a 16-tooth rotary head and operated at a tip speed of about 400 ft./min. for about 5 minutes. The weight amount of the iron particles in the magnetorheological material is equivalent to a volume fraction of about 0.30. The presence of the abrasive ferrite powder in this magnetorheological material efficiently removes the contamination products from the surface of the iron particles. The magnetorheological material whose particle component has been modified by abrader processing is stored in a polyethylene container.

COMPARATIVE EXAMPLE 7

A magnetorheological material is prepared according to the procedure described in Example 6 with the exception that the abrasive ferrite powder is excluded. The weight amount of the oil component is modified to maintain an iron particle volume fraction in the magnetorheological material of 0.30. This conventional magnetorheological material is stored in a polyethylene container.

Magnetorheological Activity for Examples 6 & 7

The magnetorheological materials prepared in Examples 6 and 7 are evaluated through the use of parallel plate rheometry. A summary of the magnetorheological effect observed for these magnetorheological materials at various magnetic field strengths and 25° C. is provided in Table 3. A significantly higher magnetorheological effect is observed for the magnetorheological material utilizing particles wherein contamination products have been removed by the presence of an abrasive additive in an abrader process (Example 6) as compared to a magnetorheological material containing conventional particles (Example 7). At a magnetic field strength of 5000 Oersted the magnetorheological effect exhibited by the magnetorheological material containing the abrader process modified particles is about 147% greater than that exhibited by a conventional magnetorheological material.

TABLE 3

| | | Magnetic Field Strength (Oersted) | | | | |
|---|---|---|---|---|---|---|
| | | 1000 | 2000 | 3000 | 4000 | 5000 |
| Magneto-rheological Effect (kPa) | Example 6 | 11.2 | 31.4 | 62.5 | 93.1 | 122.4 |
| | Comparative Example 7 | 7.74 | 31.8 | 43.5 | 46.6 | 49.5 |

EXAMPLES 8–10

In Example 8, a magnetorheological material is prepared by adding together a total of 117.9 g of straight carbonyl iron powder (MICROPOWDER S-1640, GAF Chemicals Corporation), 1.18 g of Boron Carbide (99%, Johnson Matthey Company) as an abrasive additive, 2.36 g organomodifed polydimethylsiloxane copolymer (SILWET L7500, Union Carbide Chemicals and Plastics, Company, Inc.) as a hydrogen-bonding thixotropic agent and 27.55 g of 10 cstk silicone oil (L-45, Union Carbide Chemicals and Plastics Company, Inc.). The fluid is initially mixed by hand with a spatula (low shear) and then more thoroughly dispersed into a homogeneous mixture through the use of a high speed disperserator (high shear) equipped with a 16-tooth rotary head and operated at a tip speed of about 400 ft./min. for about 5 minutes. The weight amount of the iron particles in the magnetorheological material is equivalent to a volume fraction of about 0.32. The presence of the abrasive additive in this magnetorheological material efficiently removes the contamination products from the surface of the iron particles. The magnetorheological material whose particle component has been modified by abrader processing is stored in a polyethylene container.

Magnetorheological materials are prepared in Examples 9 and 10 according to the procedure described for Example 8. However, in Example 9 the boron carbide powder is replaced with 1.51 g silicon carbide powder (alpha, 99.8%, Johnson Matthey Company) as an abrasive additive. In Example 10, the abrasive additive is replaced with 2.43 g iron (II, III) oxide powder (97%, Johnson Matthey Company). The weight amount of the iron particles in each of the magnetorheological materials is equivalent to a volume fraction of about 0.32. The magnetorheological materials whose particle component has been modified by abrader processing is stored in a polyethylene container.

COMPARATIVE EXAMPLE 11

A magnetorheological material is prepared according to the procedure described in Example 8. However, in this case no abrasive additive is incorporated into the magnetorheological material. The amount of the carrier oil component is appropriately increased to insure that the volume fraction of iron particles in the magnetorheological material is about 0.32. The conventional magnetorheological material is stored in a polyethylene container.

Magnetorheological Activity for Examples 8–11

The magnetorheological materials prepared in Examples 8, 9, 10 and 11 are evaluated through the use of parallel plate rheometry. A summary of the magnetorheological effect observed for these magnetorheological materials at various magnetic field strengths and 25° C. is provided in Table 4. A significantly higher magnetorheological effect is observed for the magnetorheological materials utilizing particles wherein contamination products have been removed by the presence of an abrasive additive or iron oxide particles in an abrader process (Examples 8-10) as compared to a magnetorheological material containing conventional particles (Example 11). At a magnetic field strength of 3000 Oersted the magnetorheological effect exhibited by the magnetorheological material containing the abrader process modified particles is about 74% greater than that exhibited by a conventional magnetorheological material.

TABLE 4

| | | Magnetic Field Strength (Oersted) | | |
|---|---|---|---|---|
| | | 1000 | 2000 | 3000 |
| Magneto-rheological Effect (kPa) | Example 8 | 18.8 | 74.3 | 131.0 |
| | Example 9 | 26.2 | 73.8 | 129.5 |
| | Example 10 | 10.8 | 62.4 | 120.6 |
| | Comparative Example 11 | 22.5 | 46.5 | 69.4 |

EXAMPLE 12

A magnetorheological material is prepared by adding together a total of 117.9 g of reduced carbonyl iron powder (MICROPOWDER R-1430, GAF Chemicals Corporation), 1.90 g of hydrophobic fumed silica (CABOSIL TS-720, Cabot Corporation) and 29.95 g of 10 cstk silicone oil (L-45, Union Carbide Chemicals and Plastics Company, Inc.). The fluid is initially mixed by hand with a spatula (low shear) and then more thoroughly dispersed into a homogeneous mixture through the use of a high speed disperserator (high shear) equipped with a 16-tooth rotary head and operated at a tip speed of about 400 ft./min. for about 5 minutes. The weight amount of the iron particles in the magnetorheological material is equivalent to a volume fraction of about 0.32. The presence of the abrasive hydrophobic silica powder in this magnetorheological material efficiently removes the contamination products from the surface of the iron particles. The magnetorheological material whose particle component has been modified by abrader processing is stored in a polyethylene container.

COMPARATIVE EXAMPLE 13

A magnetorheological material is prepared according to the procedure described in Example 12 with the exception that the hydrophobic silica powder is replaced with an identical amount of a hydrophilic silica gel dispersant (HI-SIL 233, PPG Industries). This silica gel dispersant, which has previously been disclosed as a dispersant in U.S. Pat. No. 4,992,190, is dried in a convection oven at 130° C. for 24 hours prior to use. This magnetorheological material contains a particle volume fraction of 0.32. This conventional magnetorheological material is stored in a polyethylene container.

Magnetorheological Activity for Examples 12 & 13

The magnetorheological materials prepared in Examples 12 and 13 are evaluated through the use of parallel plate rheometry. A summary of the magnetorheological effect observed for these magnetorheological materials at various magnetic field strengths and 25° C. is provided in FIG. 1. A significantly higher magnetorheological effect is obtained for the magnetorheological material utilizing particles wherein contamination products have been removed by the presence of an abrasive hyrophobic silica additive in an abrader process (Example 12) as compared to a magnetorheological material containing conventional particles (Example 13). At a magnetic field strength of 5000 Oersted the magnetorheological effect exhibited by the magnetorheological material containing the abrader process modified particles is about 167% greater than that exhibited by a conventional magnetorheological material.

As can be seen from the above examples, magnetorheological materials that contain a particle component that has been modifed by the removal of inherent contamination products through chemical treatment or abrader processing exhibit a significantly higher magnetorheological effect than conventional magnetorheological materials.

We claim:

1. A magnetorheological material comprising a carrier fluid and magnetically active particles wherein the particles are encapsulated with a protective coating and have diameters ranging from about 0.1 to 500 μm, said protective coating covering from about 95 to 100 percent of the surface of said particles and comprising at least one material selected from the group consisting of thermoplastics, non-magnetic metals and ceramics.

2. A magnetorheological material according to claim 1 wherein the protective coating is applied by a physical vapor deposition method, a physical liquid or wetting method, or a chemical vapor deposition method.

3. A magnetorheological material according to claim 2 wherein the physical vapor deposition method is selected from the group consisting of direct, reactive, activated reactive and ion-beam assisted evaporation; diode, alternating, triode, hollow cathode discharge, sputter ion, direct current radio frequency (DC/RF) and cathodic arc glow discharge ion plating; direct, cluster ion and ion beam plating; DC/RF diode, triode and magnetron glow discharge sputtering; and single and dual ion beam sputtering; the physical liquid or wetting method is selected from the group consisting of air spraying, airless spraying, dipping, spinning-on, electrostatic spraying, spray pyrolysis, spray fusion, bed fluidized, electrochemical deposition, chemical deposition electroless deposition and chemical reduction; intermetallic compounding, and colloidal dispersion and sol-gel coating; and the chemical vapor deposition method is selected from the group consisting of conventional, low pressure, laser-induced, electron-assisted, plasma-enhanced and reactive-pulsed chemical vapor deposition, and chemical vapor polymerization.

4. A magnetorheological material according to claim 1 wherein the particles are comprised of a material selected from the group consisting of iron, iron alloys, iron nitride, iron carbide, carbonyl iron, chromium dioxide, low carbon steel, silicon steel, nickel, cobalt, and mixtures thereof.

5. A magnetorheological material according to claim 1 wherein the protective coating covers 100 percent of the surface of the particles.

6. A magnetorheological material according to claim 1 wherein the protective coating covers from about 98 to 100 percent of the surface of the particles.

7. A magnetorheological material according to claim 1 further comprising contaminating materials on the surface of the particles underneath the protective coating.

8. The magnetorheological material of claim 7 wherein the thermoplastics are selected from the group consisting of acrylics, cellulosics, polyphenylene sulfides, polyquinoxilines, and polybenzimidazoles.

9. The magnetorheological material of claim 7 wherein said nonmagnetic metal is selected from the group consisting of titanium, zirconium, hafnium, vanadium, niobium, tantalum, chromium, molybdenum, tungsten, copper, silver, gold, lead, tin, zinc, cadmium, cobalt-based intermetallic alloys and nickel-based intermetallic alloys.

10. The magnetorheological material of claim 7 wherein the surface of said particles is free from corrosion products.

11. A magnetorheological material according to claim 1 wherein the protective coating comprises a nonmagnetic metal.

12. A magnetorheological material comprising a carrier fluid, magnetically active particles having a diameter from about 0.1 to 500 microns and an acid cleaner selected from the group consisting of oxalic acid, gluconic acid, ammonium persulfate, sodium acid sulfate, sodium bifluroride salts, sulfuric acid, phosphoric acid, and hydrochloric acid.

13. The magnetorheological material of claim 12 wherein said particles are present in an amount equal to from about 5 to 50 volume percent of said magnetorheological material.

14. The magnetorheological material of claim 13 wherein said acid cleaner is present in an amount equal to from about 0.1 to 5.0 weight percent of said particles.

15. The magnetorheological material of claim 14 wherein said acid cleaner is present in an amount equal to from about 0.5 to 3.0 weight percent of said particles.

16. The magnetorheological material of claim 12 wherein said acid cleaner comprises phosphoric acid.

17. A magnetorheological material comprising a carrier fluid, magnetically active particles having a diameter from about 0.1 to 500 microns and an alkaline cleaner selected from alkali metal condensed phosphates.

18. The magnetorheological material of claim 17 wherein said particles are present in an amount equal to from about 5 to 50 volume percent of said magnetorheological material.

19. The magnetorheological material of claim 18 wherein said alkaline cleaner is present in an amount equal to from about 0.1 to 5.0 weight percent of said particles.

20. The magnetorheological material of claim 18 wherein said alkaline cleaner is present in an amount equal to from about 0.5 to 3.0 weight percent of said particles.

21. The magnetorheological material of claims 1, 12 or 17 wherein said magnetically active particles have a diameter from about 1.0 to 50 microns.

22. A magnetorheological material according to claims 1, 12 or 18 further comprising a thixotropic additive selected from group consisting of hydrogen bonding thixotropic agents and colloidal additives.

23. A magnetorheological material according to claims 1, 12 or 18 further comprising a surfactant.

24. A magnetorheological material according to claims 12 or 18 wherein the carrier fluid is selected from the group consisting of mineral oils, silicone oils, chlorinated hydrocarbons, diesters, polyoxyalkylenes, perflurorinated polyethers, and flurorinated silicones.

25. A magnetorheological material according to claim 24, wherein the carrier fluid is a silicone oil or a mineral oil.

26. A method for producing a magnetorheological material having a carrier fluid and magnetically active particles having a diameter from about 0.1 to 500 microns and a protective coating, the method comprising applying a protective coating to the surface of the magnetically active particles having a diameter of about 0.1 to 500 microns so that said protective coating encapsulates from about 95 to 100 percent of the surface of said particles, wherein said protective coating comprises at least one material selected from the group consisting of thermoplastics, nonmagnetic metals and ceramics and then mixing said carrier fluid with the coated magnetically active particles.

27. The method of claim 26 wherein from about 98 to 100 percent of the surface of said particles is covered by said protective coating.

28. The method of claim 26 wherein said magnetically active particles have contaminating materials on their surface prior to said application of said protective coating.

29. The method of claim 28, further comprising treating said particles to remove said contaminating materials contaminant from the surface of said magnetically active particles prior to said application of said protective coating.

* * * * *